US006202632B1

(12) United States Patent
Geiger et al.

(10) Patent No.: US 6,202,632 B1
(45) Date of Patent: Mar. 20, 2001

(54) CANISTER PURGE VALVE FOR HIGH REGENERATION AIRFLOW

(75) Inventors: Ulrich Geiger, Hanstedt; Martin Kloda, Köln; Christof Schmidt, Regensburg, all of (DE)

(73) Assignee: Siemens Canada Ltd., Ontario (CA)

( * ) Notice: Subject to any disclaimer, the term of this patent is extended or adjusted under 35 U.S.C. 154(b) by 0 days.

(21) Appl. No.: 09/277,925

(22) Filed: Mar. 29, 1999

(51) Int. Cl.[7] ..... F02M 37/04
(52) U.S. Cl. ..... 123/520; 123/519
(58) Field of Search ..... 123/520, 519, 123/518, 516, 521, 198, 357

(56) References Cited

U.S. PATENT DOCUMENTS 4,127,097 * 11/1978 Takimoto ..... 123/520
5,060,621 * 10/1991 Cook ..... 123/520
5,216,998 * 6/1993 Hosoda ..... 123/520
5,289,811 * 3/1994 Covert ..... 123/520
5,353,220 * 10/1994 Osanai ..... 123/520
5,375,579 * 12/1994 Murai ..... 123/520
5,396,873 * 3/1995 Yamanaka ..... 123/520
5,456,238 * 10/1995 Horiuchi ..... 123/520

* cited by examiner

*Primary Examiner*—Carl S. Miller

(57) ABSTRACT

The present invention pertains to an adjustable canister purge valve (9) and method having a first connection (10) for an intake pipe (11) of an engine and a second connection (14) for an activated carbon filter (5). The first (10) and second connection (14) are interconnected by means of a first adjustable valve (16) enabling the flow of a regenerating mixture (8) of air and fuel-vapor. A second valve having a larger flow cross-section (22) is connected in parallel with the first valve (16) and allows a large regeneration air flow, even with a low suction vacuum, and thus improved purge.

18 Claims, 1 Drawing Sheet

CANISTER PURGE VALVE FOR HIGH REGENERATION AIRFLOW

FIELD OF INVENTION

The present invention pertains to controllable canister purge valves and a method for their operation.

BACKGROUND OF THE INVENTION

Canister purge valves are used to prevent evaporated fuel, in particular hydrocarbons, from escaping into the atmosphere. For this reason, an activated carbon canister is connected to the fuel tank. The canister is able to retain the fuel that has evaporated from the tank. For this reason the fuel tank is ventilated only through the filter. However, the activated carbon container provides only a limited holding volume. Consequently, the activated carbon must be continuously purged. To this end, the running engine takes air through the filter that is supplied as a combustion mixture to the motor. To maintain the exhaust emissions within statutory limits and to ensure favorable engine running conditions, the supply of the regenerating mixture of air and fuel vapor from the activated carbon filter to the engine is controlled. The canister purge valve is thus opened or closed by the purge valve so that the desired purge is timed through an adjustment of the engine characteristics, for example, according to the load and rotational speed parameters. Usually, the purging of the active carbon filter is deactivated in specific operating ranges. This, for example, occurs during idle time and under full load. The latter results from the lack of vacuum in an intake manifold of the motor, so that no regenerating mixture of air and fuel vapor can be drawn off from the activated carbon. Furthermore, a lambda control can be engaged to adjust the flow volume of the regenerating mixture of air and fuel vapor to the desired exhaust emission performance of the engine.

SUMMARY OF THE INVENTION

It is an object of the present invention to provide a canister purge valve and a process for operating the canister purge valve that is suitable for varying operating conditions and for large flow volumes of a mixture of air and fuel vapor.

This and other objects are achieved according to the present invention by an adjustable canister purge valve. The purge valve comprises a first connection for an intake pipe of an engine; a second connection for a filter; a first, adjustable valve; and a second valve. The first and second connections are interconnected through the first and second valves and the valves are arranged in parallel.

The above and other objects are also achieved according to thc present invention by a method of operating a canister purge valve. The method comprises the steps of providing a first controllable valve having a first flow cross-section and arranged between a first and a second connection through which a regenerating mixture of air and fuel-vapor flows and which can be opened for regenerating an activated carbon filter; and providing a second valve between the first and second connections and connected in parallel with the first valve.

Further advantageous characteristic features of a preferred embodiment of the present invention are explained in detail in the attached drawing. Additional developments of the invention are provided by combining these developments and the characteristic features referred to above.

BRIEF DESCRIPTION OF THE DRAWING

The FIGURE shows an embodiment of the canister purge valve according to the present invention.

DETAILED DESCRIPTION OF THE INVENTION

Figure 1:
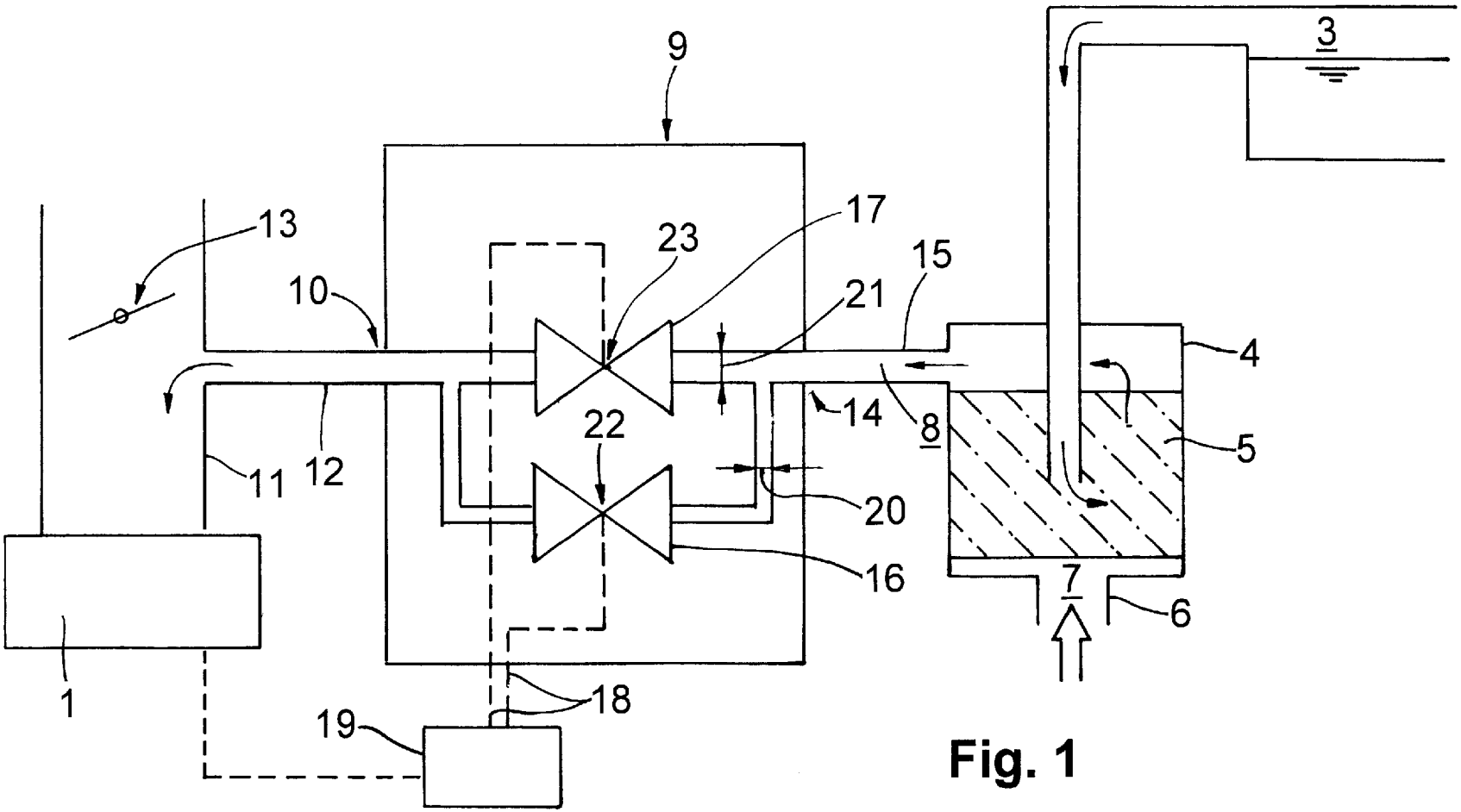

A controllable canister purge valve comprises a first connection to the intake pipe of an engine and a second connection to an activated carbon filter. The first and the second connections are interconnected through a first controllable valve enabling the flow of a regenerating mixture of air and fuel vapor, as well as through a second valve connected in parallel with the first. This configuration enables regulating or controlling the available flow cross-section by means other than merely a single valve. Moreover, the flow cross-section that is parallel to the second valve can be additionally used, to the extent that the load on the engine, makes it not only possible, but even necessary. Adding a regenerating mixture of air and fuel-vapor to the engine air intake has a considerable influence on the mixture composition in the engine.

It is advantageous if the first valve has a smaller flow cross-section than does the second valve. This enables the use of the first valve through a certain range of engine performance characteristics for a sufficiently fine control of the purging of the activated carbon filter. Only when the engine performance characteristics for controlling the first or the second valve allow, for example, a short, complete purging of the activated carbon filter, or when the differential pressures are low, will the second valve be opened. Because these types of load ratios in the engine result in the regenerating mixture of air and fuel vapor having only a negligible influence upon the mixture composition in the engine, which can be compensated by regulating an existing mixture, in one embodiment it suffices that the second valve have only a closed or an open position. The second valve, then, is switched solely between these two positions. Intermediate settings for the flow cross-section, of the sort possible with the first valve, are not employed in the second valve.

It has been found that a ratio of the first flow cross-section of the first valve to the second flow cross-section of the second open valve ranging between 0.25 and 0.5 is appropriate to adjust to a corresponding engine load when the vehicle is running. While a canister purge valve, using a single valve, may usually have a flow cross-section diameter of, for example, 3 or 4 mm, the use of an additional parallel connected second valve of a second flow cross-section at least 10 mm in diameter was found to be positive. The interaction of these two different flow cross-sections allows the regenerating mixture of air and fuel vapor to be controlled very precisely in a first engine performance regime and in a second engine performance regime, the transition to a maximum controlled flow.

An extremely precise control of the desired flow of the regenerating mixture of air and fuel vapor through the canister purge valve can be attained with a solenoid valve. The use of a lifting magnet valve on the first and second valve is preferred. For example, in one embodiment of the canister purge valve, the second valve also utilizes the solenoid valve of the first valve. This arrangement provides an extremely compact assembly of the tank lifting valve which, compared with the previously used valves, requires only slightly more space. Apart from canister purge valves, however, other valve types may also be used.

An embodiment of the present invention also provides for a process for operating a canister purge valve having first and second valves. The first valve, which may be continuously regulated or adjusted, comprises a first flow cross-section arranged between a first and a second connection through which flows a regenerating mixture of air and fuel vapor. The first valve can be opened for the purging of an attachable activated carbon filter, and provides that, for purging, a second valve contiguous and connected in parallel to the first valve, be opened. This method enables a greater flow through the canister purge valve without having to relinquish the regulating function of the first valve. Preferably, therefore, the second valve may be opened to permit a wider flow cross-section than can the first. This allows the first valve to be used in that engine performance regime in which the supply of the regenerating mixture of air and fuel vapor has a considerable effect upon the mixture composition in the engine. If greater flows of the regenerating mixture of air and fuel vapor are required, which has a minor effect on the combustible mixture composition in the engine, it is only necessary to open the second valve.

To maintain optimum engine performance characteristics for regulating the canister purge valve, initially the first valve, and subsequently the second valve, are opened. This enables the further utilization of previous control variants of the first valve. At the same time, it is possible to control the valves separately. In particular, the first valve can be adjusted or controlled very precisely, for example, by adjusting the valve lift, by pulse-modulated control of the lifting magnet, by controlling current through the lifting magnet, or by timing control. Preferably, the second valve can then be actuated simply through opening or closing operations.

A further embodiment of the process for operating the canister purge valve provides that a single opening signal is sufficient for opening the first valve, while the second valve is opened only when the opening signal exceeds a threshold value. Because the canister purge valve is commanded by means of an engine control unit, the use of a single opening signal allows the previously used connections of the engine controls to remain unmodified. Nor will it be necessary to provide additional signal lines that could possibly require different connecting values for the opening signal of the respective valve. To the contrary, the use of the single opening signal for both valves provides that a change in the components required for operating the canister purge valve is to be effected to a very limited extent and that, in an ideal case, it only concerns the magnitude of the opening signal as a function of the engine performance characteristics. A pulse-modulated signal or a controlled electrical current is preferably used as the opening signal. When, for instance, a solenoid plunger magnet is used, the signal circulates through the coil and opens the valve. The control signal can now be adjusted so that, up to a predetermined threshold value, the coil is able to open the first valve. Only after the coil signal has exceeded this threshold value will the generated electromagnetic force be able to open the second valve in addition to the first valve.

Because a second valve can be opened in addition to the first valve when operating the canister purge valve, the first valve can be controlled proportionately, and the second valve can be set to fully open or fully closed. As a result, it is possible to fall back on previous control values for the first valve to make further use of those values. To control the second valve, it is then necessary to fall back on the control values for the first valve, so that no additional control circuits have to be provided for the canister purge valve.

That a second valve can be opened together with the first valve during operation enables the regeneration of the activated carbon filter using flow cross-sections that previously could not be realized. This allows, for example, a regeneration of the activated carbon filter when the vacuum in the engine intake manifold is low, even when the engine is at full load. To achieve this, either or both of the first and second valves are opened. The two-stage valve allows, for example, an optimal fine adjustment with high differential pressure but low required throughput, as well as with low differential pressure but high required throughput. The previously known single stage valves only provided a compromise in the face of these contradictory requirements.

The drawing shows a canister purge system according to the present invention. From a fuel tank 2, the fuel vapor 3 enters into an activated carbon container 4. An activated carbon filter 5 is provided in the container 4. The container 4 has an intake 6 for the influx of regeneration air 7 into the activated carbon filter 5. As a result, a regenerating mixture 8 of air and fuel vapor is formed which is fed to a canister purge valve 9. The canister purge valve 9 is provided with a first connection 10 for an intake pipe 11 that leads to a combustion engine 1, which is controlled by an engine control device 19. A first duct 12 from the first connection 10 behind the throttle valve 13 runs into the intake pipe 11. The canister purge valve 9 is provided with a second connection 14. A second pipe 15 connects the second connection 14 with the activated carbon container 4. The valve 9 is provided with a first valve 16 and a second valve 17. The first valve 16 is connected between the first connection 10 and the second connection 14. The second valve 17 is connected in parallel with the first valve 16. The first valve 16 and the second valve 17 are connected via control lines 18 to the engine control 19 device. The first valve 16 in this embodiment is continuously adjustable, while the second valve 17 may be controlled between two discrete settings.

In the embodiment of the canister purge valve 9, as represented in the drawing, the diameter 20 for the inlet line to the first valve 16 is slightly smaller than the diameter 21 of the inlet line to the second valve 17, the latter having the shortest path between the first connection 10 and the second connection 14. This configuration confers the advantage that line losses are reduced, due to the smaller line diameter in the canister purge valve 9. On the other hand, the connection of the second valve 17 on the shorter link between the first connection 10 and the second connection 14 offers the advantage of a lower loss of pressure with a high flow rate and with an open second valve 17. The use of the larger second line diameter 17 also offers the possibility of continuing the use of existing connections having a corresponding dimension. The first valve 16 is adjustable, which means its first flow cross-section 22 is set as a variable choke as a function of the engine performance characteristics by means of the engine control device 19. The second valve 17, with the second cross-section of flow 23 in its opening position, is provided with a large flow cross-section without significant loss of pressure. The first valve 16, as well as the second valve 17, are closed in their normal position so that, only if required, at least the first valve 16 is opened for regenerating the activated carbon filter 5 and only then does it require an opening signal via the control lines 18.

The described embodiment of the canister purge valve 9 allows for an optimal regeneration of the activated carbon filter 5. Based on the information given by the sensors and measuring devices (not shown) and the various calculations performed in the engine control device 19, this is where the values for the vacuum in the intake pipe and for the permissible volume of the regenerating mixture 8 of regeneration air and fuel vapor must be adjusted. If the vacuum in the intake pipe 11 is high, i.e., if there is a great difference in pressure between the intake 6 of the activated carbon container and the intake pipe 11, but only little regeneration air is required, the volume of regeneration air 7 passing through the valve 22 can be adjusted very precisely. The valve 22 then receives, by means of the control lines 18, a signal proportional to the desired volume of regeneration air 7. This may be a pulse-modulated signal or an adjusted voltage or an adjusted current corresponding to the desired value. With pulse modulation, the valve 22 is opened completely and then fully closed again in quick succession, and the ratio between the opening times and the closing times determines the amount of the regeneration air flow. If the vacuum in the intake pipe 11 is low, i.e., if there is only a minor pressure difference between the intake 6 of the activated carbon container 4 and the intake pipe 11, while, at the same time, a larger flow of regeneration air is required, both valves 16 and 17 can be opened, as a result of which a larger flow cross-section is attained. This can be set to ensue upon a specific threshold value for the pressure difference and the required throughput in regeneration air. Typically, the threshold value is reached if the valve 16 is permanently open, while the throughput of regeneration air, is still insufficient.

The present invention is suitable, in particular, for motor vehicles that are required to meet particularly high environmental standards. Because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An adjustable canister purge valve comprising:

a first connection for an intake pipe of an engine;

a second connection for a filter;

a continuously adjustable first valve interconnecting the first and second connections; and a second valve operable between discrete positions, the second valve interconnecting the first and second connections and being arranged in parallel with the first valve.

2. The canister purge valve according to claim 1, wherein the first valve has a smaller flow cross-section than the second valve.

3. The canister purge valve according to claim 1, wherein the second valve has only an open position and a closed position.

4. The canister purge valve according to claim 2, wherein the ratio of the diameter of the flow cross-section of the first valve to the diameter of the flow cross-section of the second valve, when both valves are open, is between 0.25 and 0.5.

5. The canister purge valve according to claim 2, wherein the second valve has a second flow cross-section diameter of at least 10 mm.

6. The canister purge valve according to claim 1, wherein the first and the second valves are solenoid-actuated valves.

7. The canister purge valve according to claim 6, wherein the second valve shares the solenoid valve of the first valve.

8. A method of operating a canister purge valve, comprising:

providing a first controllable valve arranged between a first connection and a second connection, and through which a regenerating mixture of air and fuel-vapor flows;

using feedback to continuously regulate opening the first valve to regenerate an activated carbon filter;

providing a second valve between the first and second connections and connected in parallel with the first valve; and using open-loop control to operate the second valve.

9. The method according to claim 8, wherein the second valve, when open, has a larger flow cross-section than compared with that of the first valve when open.

10. The method according to claim 8, further comprising the steps of. opening the first valve; and after the first valve is open, opening the second valve.

11. The method according to claim 8, wherein the timing of the steps of opening the first and second valves is controlled.

12. The method according to claim 11, wherein the first valve is opened in response to a single opening signal, and the second valve is opened only when the value of opening signal exceeds a threshold value.

13. The method according to claim 12, wherein the opening signal is a pulse width modulated signal.

14. The method according to claim 8, wherein the second valve may only be directed to either an open position or a closed position.

15. A method according to claim 8, wherein either or both of the first and second valves are opened during no-load running for the purging of the activated carbon filter.

16. An adjustable canister purge valve comprising:

a first valve lying in a first path having a first cross-sectional area and interconnecting an intake pipe of an engine and a filter, the first valve being continuously adjustable; and a second valve lying in a second path having a second cross-sectional area and interconnecting the intake pipe of the engine and the filter, the second valve being operable between discrete settings, the second cross-sectional area being larger than the first cross-sectional area, and the second path being shorter than the first path.

17. An adjustable canister purge valve comprising:

a first connection for an intake pipe of an engine;

a second connection for a filter;

an adjustable first valve interconnecting the first and second connections; and a second valve interconnecting the first and second connections, the second valve being arranged in parallel to the first valve;

wherein a single opening signal actuates both valves.

18. The adjustable canister purge valve according to claim 17, wherein first valve is actuated below a threshold value of the single opening signal, and the first and second valves are actuated above the threshold value of the single opening signal.

* * * * *